United States Patent [19]

Daleo

[11] 4,162,622

[45] Jul. 31, 1979

[54] MULTIPLE-CUFF HANDCUFF

[75] Inventor: Joseph Daleo, Deer Park, N.Y.

[73] Assignee: Triple Cuff Corporation, Melville, N.Y.

[21] Appl. No.: 888,368

[22] Filed: Mar. 20, 1978

[51] Int. Cl.[2] ..... E05B 75/00

[52] U.S. Cl. ..... 70/16

[58] Field of Search ..... 70/14, 15, 16, 17, 18; 119/126, 127, 128

[56] References Cited

U.S. PATENT DOCUMENTS

| | | | |
|---|---|---|---|
| 381,005 | 4/1888 | Ferrell | 70/16 |
| 470,869 | 3/1892 | Kahlke | 70/16 |
| 1,881,577 | 10/1932 | Hillyard | 70/16 |

*Primary Examiner*—Robert L. Wolfe

*Attorney, Agent, or Firm*—Posnack, Roberts, Cohen & Spiecens

[57] ABSTRACT

A multiple-cuff handcuff is provided including two cuffs pivotally connected together along a pivot pin arranged perpendicularly thereof. A third cuff is connected to one of the aforesaid cuffs by a chain and swivels. The two pivotally connected cuffs are arranged to open in opposite polar directions.

8 Claims, 2 Drawing Figures

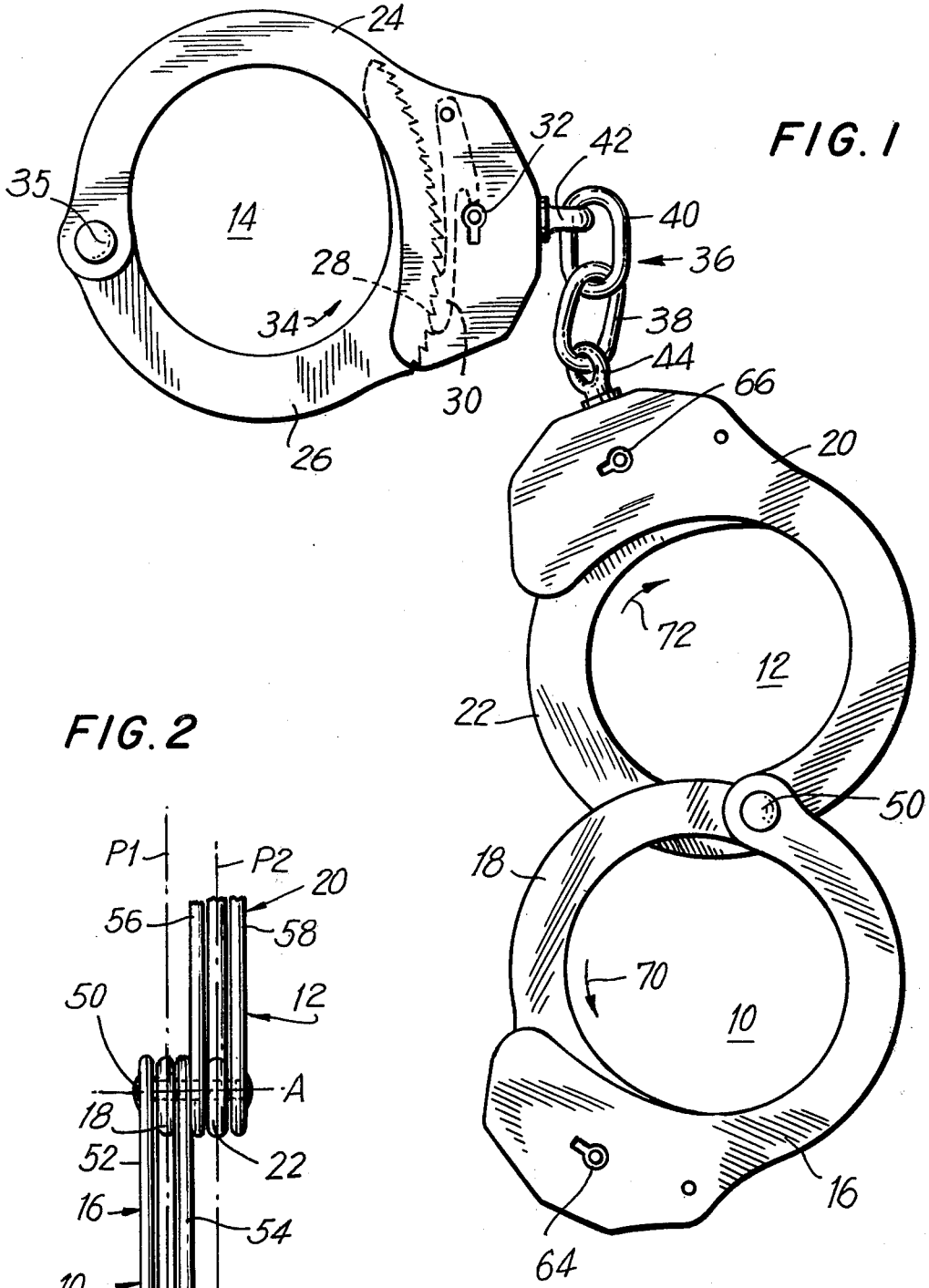
FIG. 1
FIG. 2
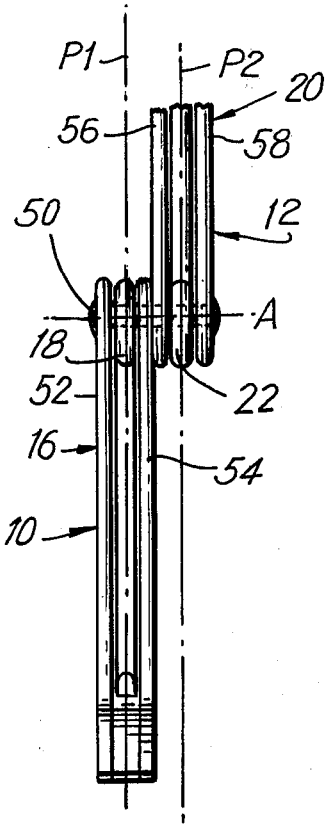

MULTIPLE-CUFF HANDCUFF

FIELD OF INVENTION

This invention relates to handcuffs and more particularly to an arrangement of three and possibly more handcuffs.

BACKGROUND

In reviewing the earlier patents preparatory considering the inventive aspects of my handcuff design, there have been found a number of patents which disclose a multiple-cuff arrangement and a possible hinged relationship between adjacent cuffs. The patents which I have seen are the following: 1,410,802; 1,823,697; 1,881,948; 1,890,748; and 2,966,787.

E. B. Foster in U.S. Pat. No. 1,410,802 discloses a manacle wherein a collar consisting of substantially circular bar and casing elements hingedly connected to each other involves the use of a lock provided in the casing for securing the free end of the bar element thereto. A pair of handcuffs is provided with means for locking the same and chains are employed which permanently connect the handcuffs to respective collar elements.

C. H. Nenstiehl in U.S. Pat. No. 1,823,697 reveals a multiple cuff arrangement especially suited for use in connection with automobiles which are employed to convey criminals. In the disclosed arrangement, there is a fixed eye member, a chain connected by a spring to the fixed eye member, and a stop bar carried by the chain. The chain is arranged to pass through a wall opening and is limited in its passage by the stop bar. A ring is provided on the chain and handcuffs are arranged on the ring. These handcuffs may be three in number.

D. B. Rayburn in U.S. Pat. No. 1,881,948 discloses an invention relating generally to shackles for prisoners adapted to encircle the waist of a prisoner and provided, with handcuffs to imprison the hands and arms of the prisoner thusly encircled. Specifically, a metallic waist belt having a self-locking girth adjusting means is provided, there being a radially enlarged handcuff mounting at the front portion of the waist belt and a pair of spaced handcuffs connected by swivels to the mounting and having girth adjusting means thereon. The waist belt is made up of a plurality of hingedly connected sections.

G. W. Pratt in U.S. Pat. No. 1,890,748 discloses an improvement in handcuffs whereby a pair of handcuffs is provided with a rigid spacer bar. One of the cuffs is collapsible with a portion of the collapsible cuff forming one portion of a handle, the other portion of the cuff being foldable in a shield forming the other portion of the handle. This arrangement does not show the use of more than two cuffs but is cited by reason of the pivotal connection of adjacent cuffs.

H. A. Tompkins in U.S. Pat. No. 2,966,787 discloses an invention directed to a novel form of a hinged handcuff in which a novel locking assembly serves as both a hinge pin to hold the hinge in operative position, and also to block and lock the individual shackles against undesired manipulation. Specifically, the handcuff of the Tompkins patent comprises a pair of wing sections respectively provided with cooperating aligned knuckles or hinge rings each wing section having an integral bow with an internal arcuate guide recess at one end of the bow; a curve closure shackle having one end pivoted on the outer end of the bow and having its opposite free end shaped as an arcuate section having ratchet teeth on the other edge thereof, such shackle being movable without its pivot to move its arcuate section into and through the arcuate guide recess in the bow. Furthermore, detent means are provided in each wing section adjacent its guide recess with pivot support means being provided for each detent means. A spring is provided to bias a detent means to engage the ratchet teeth of its assocated shackle to permit motion of the shackle in locking direction only. Furthermore, a device is provided to move the detent means to release position to permit release motion of the shackle. A lock is provided having a locking position and a non-locking position and including a cylinder disposed within the hinge rings to serve as a hinge pintle. The lock includes the feature of the cylinder being spring biased to non-locking position and being manually movable to locking position and being operative in this position to lock the detent means against movement.

SUMMARY OF INVENTION

In addition to being characterized by the usual features of a multi-cuff handcuff arrangement such as, for example, holding three persons at one time and alternatively permitting a prisoner to be handcuffed by having two hands cuffed with the attendant officer having one hand cuffed, the invention provides for various other objects and features.

It is an object of the invention to provide an improved multi-cuff handcuff.

Another object of the invention is to provide an improved arrangement wherein two cuffs can be readily mounted upon one arm or limb of a prisoner or the like.

Still another object of the invention is to provide an improved handcuff arrangement whereby two cuffs may be readily mounted on the same wrist while one cuff is employed to cover up or conceal the keyhole provided in the other cuff.

Another object of the invention is to provide an improved arrangement of cuffs whereby if the cuff locks are faced towards the prisoner who is being cuffed he would not have access to the lock even if he had the key because the cuffs are arranged so closely together.

Still another object of the invention is to provide an improved handcuff arrangement which is easier to carry and store than handcuff arrangements heretofore available.

Another object of the invention relates to the ease of manufacture which is provided for an arrangement of three cuffs which are coupled together.

Another object of the invention is to provide an improved combination of cuffs having a flexible connection between two cuffs and a further connection which is rigid along a hinge.

To achieve the above and other objects and advantages of the invention, there is provided a multiple-cuff handcuff comprising first means including first and second cuffs pivotally interconnected for movement in two parallel planes, a third cuff, and coupling means flexibly coupling said third cuff to said first means.

According to a feature of the invention, the aforesaid coupling means may be constituted at least in part by a chain consisting of a plurality of interengaged links.

According to still a further feature of the invention, the first means mentioned hereinabove may include a pivot pin common to said first and second cuffs and about which said first and second cuffs pivot in the above-mentioned parallel planes.

According to still a further advantageous arrangement of the invention, the first and second cuffs are free on said pin to pivot into overlapping generally coincident relation.

In accordance with a further feature of the invention, each of the aforesaid cuffs includes a base cuff element including two limbs and a serrated element pivotally connected between said limbs by said pin and adapted to form a closed loop with said base cuff element.

Another feature of the invention relates to the fact that the base cuff elements of said first and second cuffs are provided with keyholes on corresponding sides whereby, when said first and second cuffs are pivoted into coincident relationship, one of said keyholes is concealed.

According to another advantageous feature of the invention, the base cuff elements of said first and second cuffs are generally C-shaped members which open in opposite polar directions relative to said pin.

According to yet another advantageous aspect of the invention, the base cuff elements of all of the cuffs are of the same construction as are the serrated elements of all of the cuffs whereby to facilitate, along with other arrangements of the invention, the manufacturing techniques required.

In accordance with the invention, swivel elements couple the aforesaid chain to said first means and to the third said cuff. Furthermore, one of the swivel elements is coupled to the base cuff element of the second said cuff.

According to yet another feature of the invention, the aforesaid pivot pin is perpendicularly related to the parallel planes through which the first and second cuffs are manipulable.

The above and further objects, features and advantages of the invention will be apparent from the detailed description which follows hereinafter. This detailed description will be taken in conjunction with the accompanying drawing.

BRIEF DESCRIPTION OF DRAWING

In the accompanying drawing:

FIG. 1 is a top plan view of a triple cuff arrangement provided in accordance with the invention; and FIG. 2 is a fragmentary view from the side of the pivotal connection between two of the cuffs as provided in accordance with the invention.

DETAILED DESCRIPTION

The multiple-cuff handcuff arrangement illustrated in the drawing includes three handcuffs 10, 12 and 14. These are conventionally constructed of a strong metal such as steel or the like but may readily be manufactured of other materials such as suitable plastics. While an arrangement has been shown illustrating a triple cuff arrangement, it will be apparent from the description which follows hereinafter that further cuffs may be added to the arrangement as desired.

Each of the cuffs 10, 12 and 14 mentioned hereinabove are formed similarly or possibly identically from a base cuff element in combination with a serrated element. Thus, for example, cuff 10 is formed of a base cuff element 16 and a serrated element 18. Cuff 12 is formed from a base cuff element 20 and a serrated element 22. Cuff 14 is formed from a base cuff element 24 and a serrated element 26.

The serrated elements 18, 22 and 26 are best illustrated with reference to element 26 wherein are shown in hidden view the serrations 28. These serrations are intended to be engaged by a serrated cam element 30 which is controlled by a key controlled lock for which keyhole 32 is illustrated. It is possible to urge the element 26 in the direction of arrow 34 in order to cooperate with the C-shaped base cuff element 24 to engage a wrist or other limb therein. Pivotal motion is relative to a pivot pin 35 which pivotally connects elements 24 and 26 together. The operation of the cuff and the hidden details are of conventional type and do not warrant further consideration in this text.

Cuffs 12 and 14 are coupled together by a flexible device indicated at 36 and consisting of a flexible chain. The illustrated chain consists of interengaged chain links 38 and 40. The link 40 is connected to base cuff element 24 by means of a swivel 42 and link 38 is connected to base cuff element 20 of cuff 14 by means of a swivel 44.

Cuffs 10 and 12 are pivotally connected by means of a pivot pin 50. The pivot pin 50 is also visible in FIG. 2 in which cuffs 10 and 12 are seen as being connected together in planes P1 and P2 which are spaced from one another and are parallel and perpendicular to the axis A of the pivot pin 50. It will also be seen in FIG. 2 that the base cuff element 16 is formed of limbs 52 and 54 which straddle the serrated element 18, the limbs 52 and 54 as well as the element 18 being pivotal about the pin 50. Similarly, the base cuff element 20 consists of two spaced parallel limbs 56 and 58 which straddle the serrated element 22, all of these elements being pivotal about the pin 50 which is shared in common between cuffs 10 and 12.

From what has been stated above, it will be evident that there is provided a multi-cuff or triple cuff handcuff arrangement wherein two of the cuffs have a pivotal relationship therebetween with the cuffs being substantially rigidly related to the hinge or pivot therebetween, while at the same time, there is provided a flexible chain-like connection between the cuffs 12 and 14 which permit much more freedom of motion therebetween.

Advantages of the pivotal but substantially rigid relationship between cuffs 10 and 12 is that these cuffs are provided with keyholes 64 and 66. If these keyholes are arranged so as to face away from the hands of a prisoner who is shackled by the cuff arrangement, it will be impossible for the prisoner, even if he is provided with a key, to be able to manipulate the locks of the respective cuffs. This is due to the rigid arrangement of the cuffs in their respective planes P1 and P2. In addition, there is another advantage which inures to the benefit of the multiple-cuff arrangement of the invention in that if the cuffs 10 and 12 are arranged on a single limb (i.e., the wrist) of a prisoner, the one cuff will conceal the keyhole of the other cuff. More specifically, in the illustrated arrangement, the cuff 10 if pivoted to overlapping and substantially coincident relationship to the cuff 12 would conceal the keyhole 66, thus making an unlocking of the cuff 12 impossible without the prior opening of the cuff 10.

From what has been stated above, it will be seen that each of the cuffs includes a base cuff element including two rims and a serrated element pivotally connected between these limbs by the related pivot pin such that the elements are adapted to cooperatively form a closed loop. The closed loop is formed relative to cuff 10 by a movement of serrated element 18 in the direction of arrow 70 which represents a counter clockwise polar movement relative to pin 50 as illustrated in FIG. 1. On the other hand, serrated element 22 of cuff 12 will have to move for purposes of closing in the direction of arrow 72 which represents a clockwise polar movement relative to pin 50. Accordingly, it will be observed that the base cuff elements of the cuffs 10 and 12 are generally C-shaped members which open and close in opposite polar directions relative to the aforenoted pin 50 which is shared in common by cuffs 10 and 12.

The handcuff arrangement described above is such that three persons can be manacled at one time. For example, wrists of three prisoners can be respectively engaged by cuffs 10, 12 or 14. It will also be clear that a prisoner can be escorted by having two hands cuffed such as in cuffs 10 and 12 with an attending officer having one hand cuffed such as, for example, by cuff 14. It is also possible to rearrange these cuffs on the wrists of the respective individuals. It will also be noted that a prisoner can be cuffed by one hand with another cuff being arranged around a pole or pipe. The remaining cuff can be used to shackle a further prisoner or it may be engaged with the free wrist of the same prisoner. Similarly, it is possible to engage three prisoners with the chain 36 being passed between a pipe and a wall whereby the three prisoners would be immobilized.

As noted above, if the keyholes 66 and 64 face the prisoner and away from the prisoner's hands, the rigid relationship of cuffs 10 and 12 relative to the hinge or pivot pin 50 would prevent that prisoner from having access to the keyholes even if he were provided with a key. This is because the cuffs are arranged so closely together. As noted above also, the cuffs 10 and 12 can be arranged on the same arm of the prisoner whereby one of the keyholes will be concealed from the prisoner and access thereto will be relatively complex.

The manufacture of the three different cuffs from the same elements facilitates mass production and thereby reduces cost. The arrangement of cuffs 10 and 12 about a common pivot make the same easy to carry and to store.

The particular arrangement of one pivotal connection and one flexible connection is considered to be a special feature of the invention which restricts movements between two adjacent cuffs while allowing some flexibility of movement as between the two remaining cuffs.

There will now be obvious to those skilled in the art many modifications and variations of the handcuff structure set forth hereinabove. These modifications and variations will not depart from the scope of the invention if defined by the following claims.

What is claimed is:

1. A multiple-cuff handcuff comprising first means including first and second cuffs pivotally interconnected for movement in two parallel planes, a third cuff, and coupling means flexibly coupling said third cuff to said first means, said coupling means including a chain consisting of a plurality of interengaged links, said first means including a pivot pin common to said first and second cuffs and about which said first and second cuffs pivot in said planes, said first and second cuffs being free on said pin to pivot into overlapping, generally coincident relation.

2. A multiple-cuff handcuff as claimed in claim 1 wherein each of said cuffs includes a base cuff element including two limbs and a serrated element pivotally connected between said links by said pin and adapted to form a closed loop with said base cuff element.

3. A multiple-cuff handcuff as claimed in claim 2 wherein the base cuff elements of said first and second cuffs are provided with keyholes on corresponding sides whereby when said first and second cuffs are pivoted into coincident relationship one of said keyholes is concealed.

4. A multiple-cuff handcuff as claimed in claim 3 wherein the base cuff elements of said first and second cuffs are generally C-shaped members which open in opposite polar directions relative to said pin.

5. A multiple-cuff handcuff as claimed in claim 4 wherein the base cuff elements of all of said cuffs are the same construction and the serrated elements of all of said cuffs are of the same construction.

6. A multiple-cuff handcuff as claimed in claim 4 comprising swivel elements coupling the chain to said first means and to said third cuff.

7. A multiple-cuff handcuff as claimed in claim 4 wherein one of the swivel elements is coupled to the base cuff element of said second cuff.

8. A multiple-cuff handcuff as claimed in claim 4 wherein said pivot pin is perpendicular to said planes.

* * * * *